US006398587B1

(12) United States Patent
Chen et al.

(10) Patent No.: US 6,398,587 B1
(45) Date of Patent: Jun. 4, 2002

(54) UNIVERSAL SERIAL BUS CONNECTOR

(75) Inventors: Qiang Chen; GuangXing Shi, both of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/994,432

(22) Filed: Nov. 26, 2001

(30) Foreign Application Priority Data

Dec. 29, 2000 (TW) ..... 89222759 U

(51) Int. Cl.[7] ..... H01R 13/648
(52) U.S. Cl. ..... 439/607; 439/573
(58) Field of Search ..... 439/607–610, 439/570, 573

(56) References Cited

U.S. PATENT DOCUMENTS 5,622,522 A * 4/1997 Tan et al. ..... 439/607
5,842,886 A * 12/1998 Illa et al. ..... 439/607
6,109,966 A * 8/2000 Chiou ..... 439/607
6,290,540 B1 * 9/2001 Nishio et al. ..... 439/607

* cited by examiner

*Primary Examiner*—Hien Vu
(74) *Attorney, Agent, or Firm*—Wei Te Chung

(57) ABSTRACT

An electrical connector comprises an insulative housing, a plurality of conductive contacts, and first and a metal shell. The housing includes a main body, and a tongue board extending forwardly from a front of the main body. The shell comprises first and second conductive shields. The first shield includes a pair of two-pronged fixing portions depending from opposite sides of the first shield respectively, for engaging in a circuit board. The second shield includes two arms depending from a top thereof over outer faces of opposite sidewalls thereof. Each arm forms a bent portion at a lower end thereof, for soldering to the circuit board. Each bent portion is located higher than a bottom of the shell. The fixing portions are disposed higher than the bottom of the shell. The connector is thus attached to the circuit board at four points evenly distributed around a periphery of the connector.

6 Claims, 5 Drawing Sheets

UNIVERSAL SERIAL BUS CONNECTOR

BACKGROUND OF THE INVENTION

1. Field of the Invention

The invention relates to Universal Serial Bus (USB) electrical connectors, and more particularly to low-profile USB connectors that can be stably and reliably mounted on a printed circuit board.

2. Description of the Prior Art

The trend toward miniaturization of electronic devices demands that many such devices have a low profile. Accordingly, electrical connectors in an electronic device should have a low profile above a printed circuit board on which the connectors are mounted. In order to achieve this, a lower portion of such connectors is mounted below the printed circuit board. Examples of such mounting are disclosed in U.S. Pat. No. 4,457,570 and Taiwan Pat. Application No. 87217216. FIG. 1 shows a Universal Serial Bus (USB) connector with locating means, as disclosed in the Taiwan Pat. Application No. 87217216. Two side wings extend from two side walls of a metal shell 901 of a USB connector 9. A through hole 91 is defined in each side wall. When the connector 9 is located in a cutout 95 of a circuit board 94, the through holes 91 are aligned with two holes 92 defined in the circuit board 94. The connector 9 can thereby be firmly latched to the circuit board 94 by using two bolts 93 extended through the through holes 91 and the holes 92.

Each side wing 90 must be large enough to accommodate a through hole 91, as well as provide sufficient area for soldering of the side wing 90 to the circuit board 94. This takes up valuable space on the circuit board 94 that could otherwise be used to accommodate more circuitry and components. Additionally, USB specifications require that two resilient tabs 902 be formed at each of upper and lower walls of the shell 901 of the USB connector 9, for engaging with a shell of a USB plug and attaining effective shielding and grounding. The side wings 90 are formed by stamping of the lower wall of the shell 901, and the tabs 902 are also formed by stamping of the very same lower wall. Therefore the amount of the lower wall available for stamping of the side wings 90 is limited.

Accordingly, an improved low-profile USB connector having small and easily-formed grounding tabs is desired.

SUMMARY OF THE INVENTION

An object of the present invention is to provide a low-profile electrical connector, particularly a low-profile USB connector, which can be securely mounted on a printed circuit board and which has a shielding shell and grounding tabs that are easily formed.

Another object of the present invention is to provide a low-profile electrical connector, particularly a low-profile USB connector, which has grounding tabs that occupy minimal space on a circuit board on which the connector is mounted.

To achieve the above object, an electrical connector in accordance with a preferred embodiment of the present invention comprises an insulative housing, a plurality of conductive contacts, and a metal shell. The housing includes a main body, and a tongue board extending forwardly from a front of the main body. The housing has a front side, a rear side, and a plurality of channels defined therein. The contacts are received in the channels. Each contact includes a mating portion for electrically engaging with a mating connector, a fixing portion fixed in the housing, and a tail portion protruding from the rear side of the housing. The shell shields the housing, and comprises first and second conductive shields. The first shield includes a pair of two-pronged fixing portions depending from opposite sides of the first shield respectively, and adapted to engage in a circuit board. The second shield includes two arms depending from a top of the second shield over outer faces of opposite sidewalls of the second shield respectively. Each arm forms a bent portion at a lower end thereof, for soldering to the circuit board. Each bent portion is located higher than a bottom of the shell. Each sidewall forms a pair of spring tongues adapted for electrically engaging with a metal shell of a mating connector. The fixing portions are disposed at a rear of the arms and higher than the bottom of the shell.

The electrical connector in accordance with the preferred embodiment of the present invention is attached to the circuit board at four points evenly distributed around a periphery of the connector. The connector thus maintains sturdy and durable mechanical and grounding connection with the circuit board, even when it is subjected to unwanted force during docking or disengaging of the mating connector.

Other objects, advantages and novel features of the present invention will be drawn from the following detailed description of preferred embodiments of the present invention with attached drawings, in which:

DESCRIPTION OF PREFERRED EMBODIMENTS OF THE INVENTION

The present invention will be explained in detail by reference to the following description of the preferred embodiments.

Figure 2:
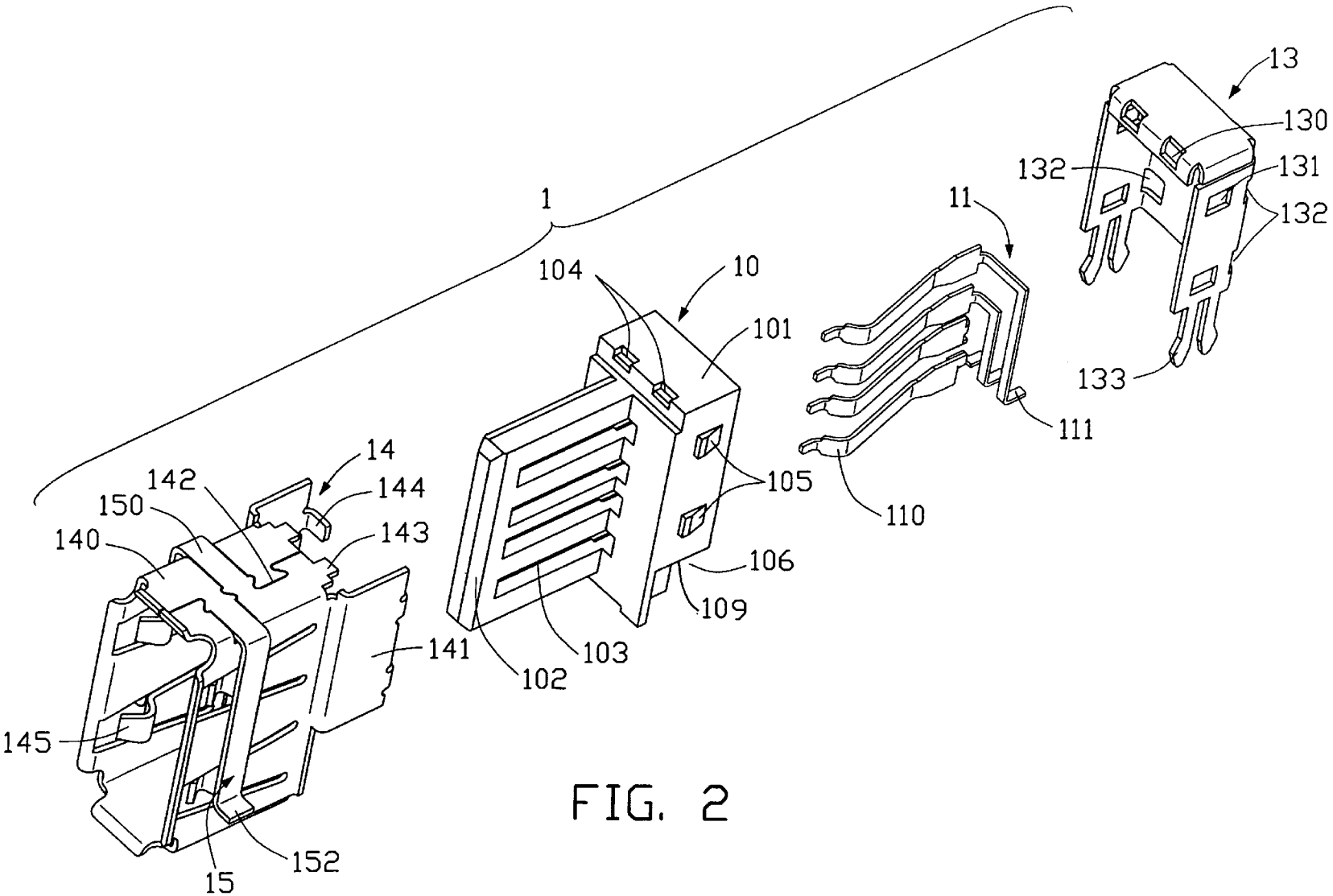
FIG. 2 is an exploded, perspective view of a USB connector in accordance with a preferred embodiment of the present invention.

As shown in FIG. 2, an electrical connector 1 in accordance with a preferred embodiment of the present invention comprises an insulative housing 10, a plurality of contacts 11, and first and second conductive shields 13, 14. The housing 10 includes a main body 101, and a tongue board 102 extending forwardly from a front of the main body 101. A plurality of channels 103 is defined in a main face of the tongue board 102 and integrally through the main body 101. A pair of indents 104 is defined at a junction of a front and a top surface of the housing 10. Two blocking tabs 105 are formed on each of opposite side faces of the main body 101. A pair of cutouts 106 (only one shown) is defined in bottommost portions of the opposite side faces of the main body 101 each with a confrontation surface 109 thereon, for facilitating engagement of the connector 1 with a printed circuit board 5 (see FIG. 3). The contacts 11 are located in the channels 103. Each contact 11 includes a mating portion 110, a bent tail portion 111 around the level of the confrontation surface 109, and a fixing portion (not labeled) formed between the mating portion 110 and the tail portion 111.

The housing 10 is enclosed by a metal shell (not labeled), for shielding the housing 10. The metal shell comprises the first and second shields 13, 14. The first shield 13 has an opening at a front thereof. Two inserting holes 130 are defined in a junction of a top and a front hood of the first shield 13. A pair of catching holes 131 is defined in top portions of opposite sides of the first shield 13 respectively. A pair of two-pronged fixing portions 133 depends from the opposite sides of the first shield 13 respectively. The fixing portions are disposed higher than a bottom of the second shield 14. A plurality of latching holes 132 is defined in a back of the first shield 13.

The second shield 14 has an opening at a front thereof. Two spring tongues 145 are formed in each of opposite sidewalls of frame 140. A part of each spring tongue 145 protrudes into an interior of the second shield 14. A side plate 141 extends rearwardly and generally coplanarly from each sidewall of the frame 140. A tag 144 extends perpendicularly inwardly from a top portion of a rear edge of each side plate 141. Two tabs 143 extend rearwardly from a rear edge of a top of the frame 140. A top of the frame 140 generally comprises two coplanar half-portions. The half-portions are irregularly but complementarily shaped, such that they are fittingly held together at a seam 142. Each half-portion is integrally joined with one sidewall, and comprises a horizontal portion 150. Each half-portion further has a vertical arm 15 depending therefrom over an outer face of an opposite sidewall. Each arm 15 depends almost to a bottom of the corresponding sidewall. A horizontal soldering portion 152 is bent outwardly from a bottom of each arm 15.

Figure 3:
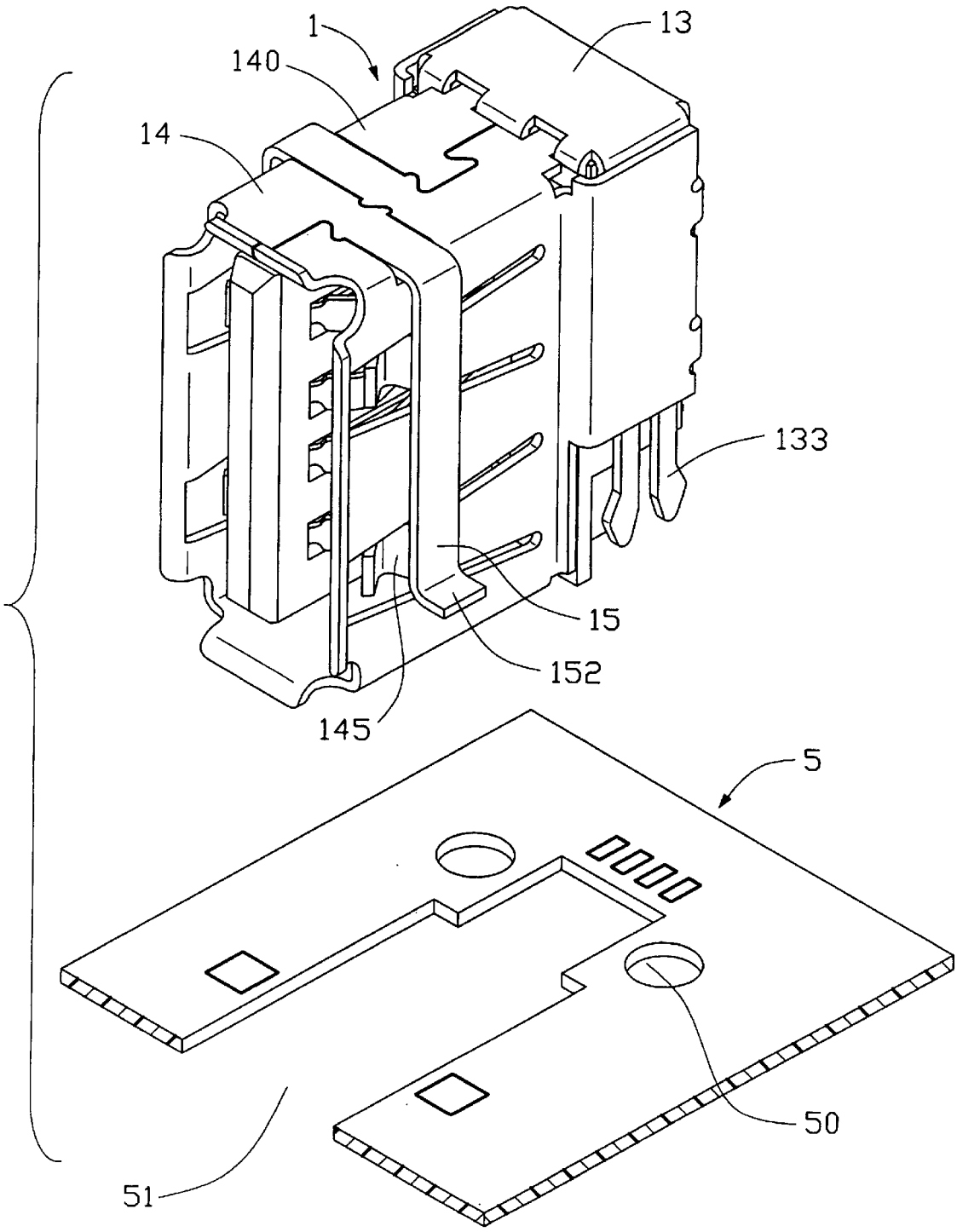
FIG. 3 is a perspective view of the connector of FIG. 2 fully assembled and ready to be mounted to a printed circuit board.
Figure 4:
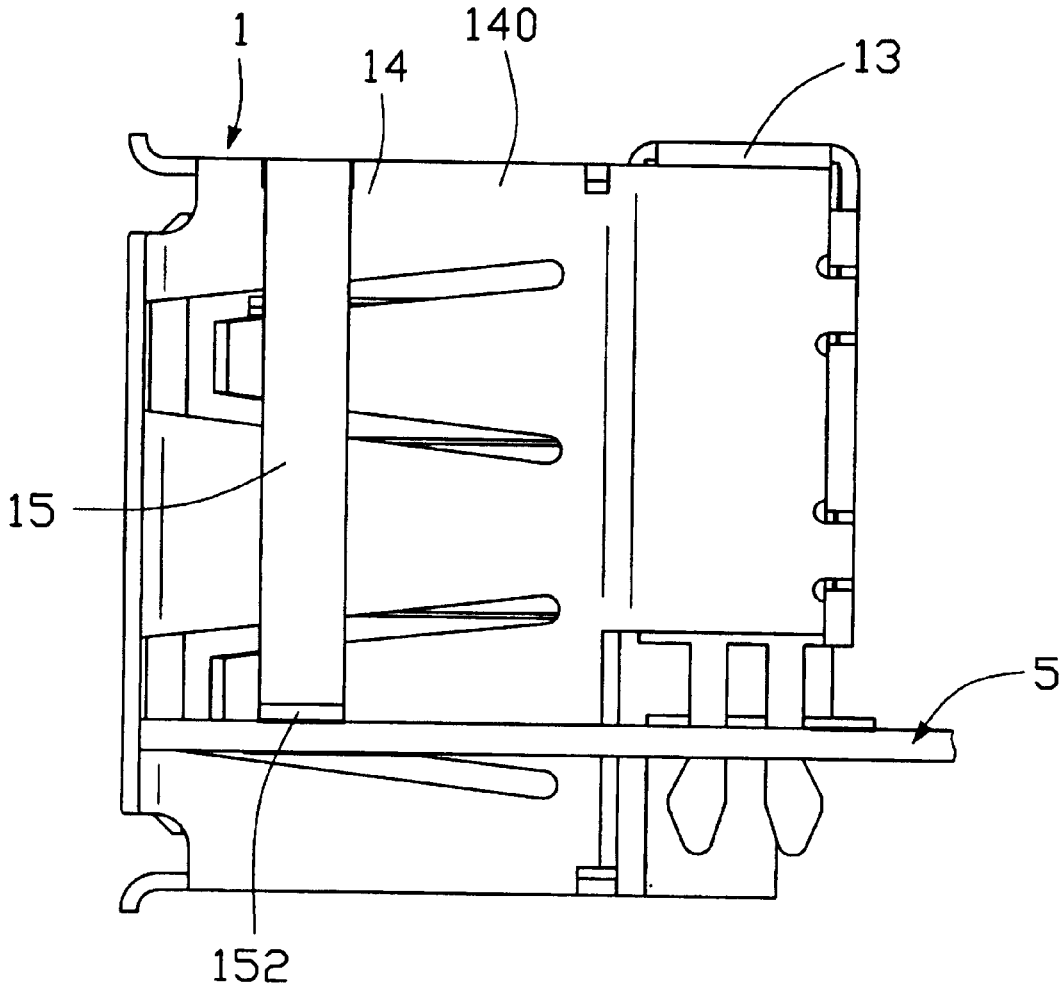
FIG. 4 is a side plan view of the connector of FIG. 3 mounted to the printed circuit board of FIG. 3.

Referring to FIG. 3, the assembled connector 1 is be mounted onto the circuit board 5. The circuit board 5 has an opening 51 corresponding to a configuration of the connector 1. The opening 51 includes a wide portion for receiving the second shield 14, and a narrow portion for receiving the housing 10 at the cutouts 106. A pair of through holes 50 is defined in the circuit board 5 on opposite sides of the narrow portion of the opening 51 respectively. Referring also to FIG. 4, the connector 1 is fittingly received in the opening 51. The fixing portions 133 of the connector 1 are secured in the through holes 50. The soldering portions 152 of the connector 1 abut the circuit board 5, for soldering thereto.

The connector 1 is attached to the circuit board 5 at four points evenly distributed around a periphery of the connector 1. The connector 1 thus maintains sturdy and durable mechanical and grounding connection with the circuit board 5, even when it is subjected to unwanted force during docking or disengaging of a mating connector. In addition, each soldering portion 152 does not need a hole defined therein. An entire area of each soldering portion 152 is available to support the connector 1, and thus a size of each soldering portion 152 can be minimized to save valuable space on the circuit board 5. Furthermore, lengths of the arms 15 and the fixing portions 133 can be changed according to the particular profile characteristics needed of a particular connector 1 in any given application. Moreover, a width of the connector 1 between the opposite sidewalls of the second shield 14 can be changed according to the particular width characteristics needed of a particular connector 1 in any given application.

Figure 1:
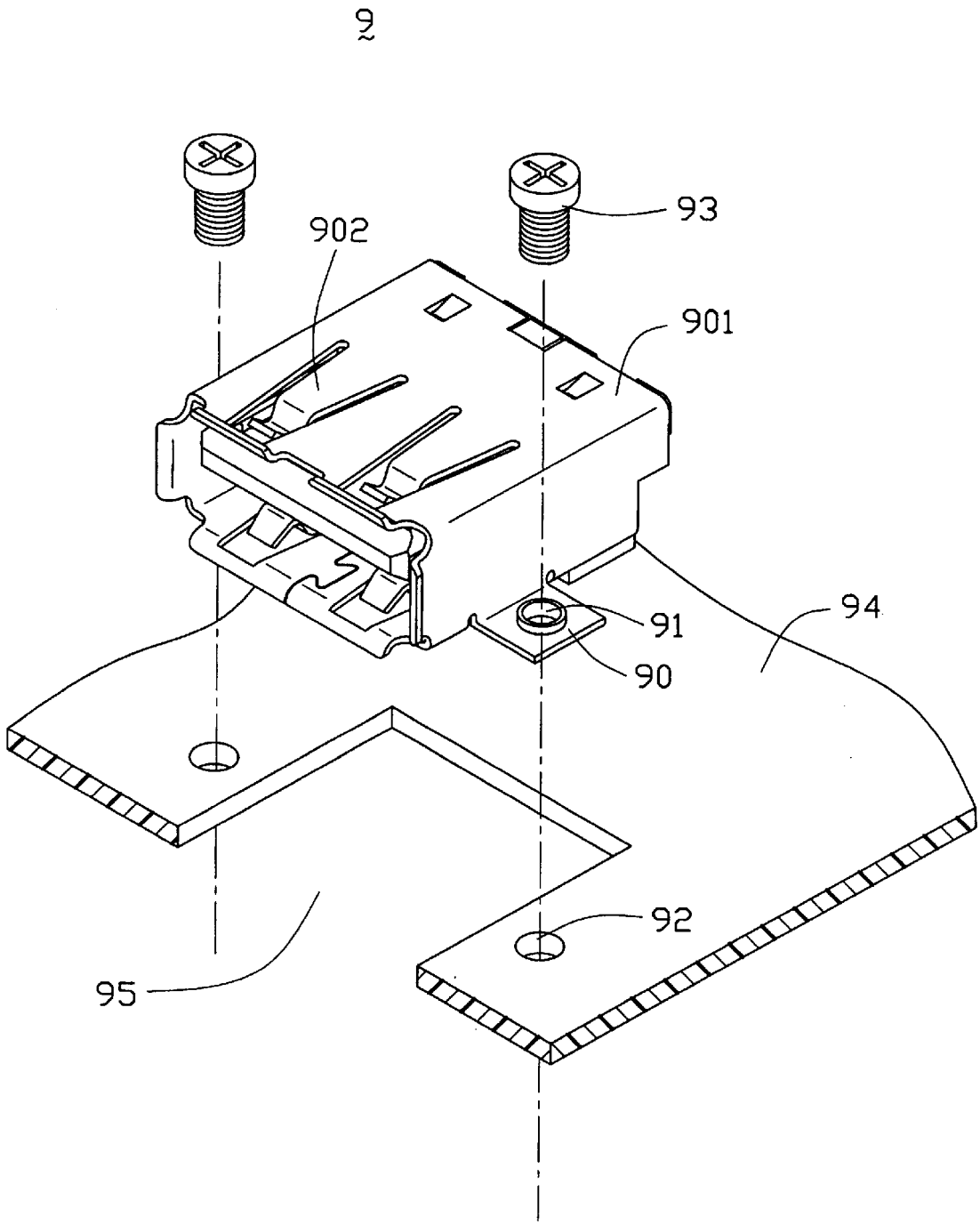
FIG. 1 (PRIOR ART)
FIG. 1 is an exploded, perspective view of a conventional USB connector to be mounted to a printed circuit board.
Figure 5:
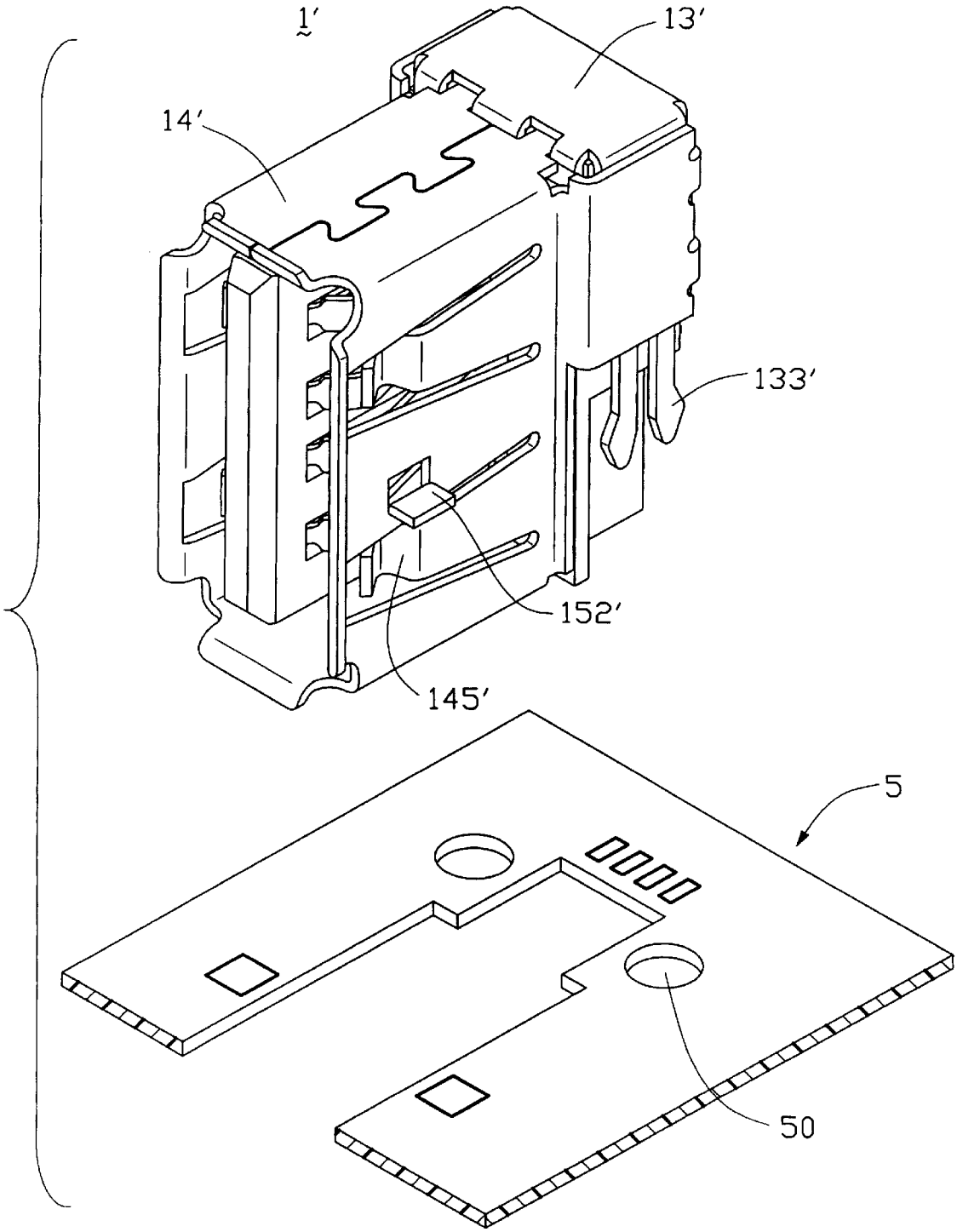
FIG. 5 is a perspective view of a fully assembled USB connector in accordance with an alternative embodiment of the present invention, ready to be mounted to a printed circuit board.

FIG. 5 shows a connector 1' in accordance with an alternative embodiment of the present invention. The connector 1' is similar to the connector 1 of the preferred embodiment. However, a first conductive shield 13' has a pair of two-pronged fixing portions 133' depending therefrom. The fixing portions 133' are disposed higher than the fixing portions 133 of the connector 1. A soldering portion 152' can be stamped horizontally outwardly directly from the adjacent sidewall of a second conductive shield 14', between a pair of spring tongues 145' of the sidewall. When the connector 1' is mounted onto a circuit board 5, the fixing portions 133' are inserted in the through holes 50 of the circuit board 5, and the soldering portions 152' are soldered to the circuit board It may be appreciated that in the first embodiment because the second shield 14 already defines the spring tongue 145 around the level of the confrontation surface 109 or the level of the horizontal tail portion 111, it is impossible to form a reliable soldering portion thereabouts. Thus, in the first embodiment the soldering portion 152 is derived from the remote side plate rather than the adjacent side plate thereof. Oppositely, in the second embodiment because the level of the confrontation surface or the tail portion is located around the mid-portion of the side plate of the second shield between the two spring tongues 145, it allows to form a reliable/immoveable soldering portion of the adjacent side plate thereof rather than via the remote one. Anyhow, regardless of whether the soldering portion of the front shield is derived from the adjacent side plate or the remote one relative to the corresponding solder pad on the printed circuit board, the feature of the invention compared with the prior art disclosed in FIG. 1, is to provide a vertical type connector with the soldering portions around a middle area of the front shield so as to allow such a vertical connector to be mounted to a printed circuit board in a low profile manner.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative housing having a front side, a rear side and a plurality of channels defined therein;

a plurality of conductive contacts received in the channels, each contact including a mating portion for electrically engaging with a mating connector, a retaining portion fixed in the housing, and a tail portion protruding from the rear side of the housing;

a metal shell shielding the housing, the shell including two arms extending from a top of the shell over outer faces of opposite sidewalls of the shell respectively, each arm forming a bent portion at a lower end thereof for soldering to a circuit board, each bent portion being located higher than a bottom of the metal shell, the metal shell further comprising a pair of fixing portions adapted for engaging in the circuit board, the fixing portions being disposed at a rear of the arms and higher than a bottom of the metal shell, each of the two side walls forming at least a resilient tab adapted for electrically engaging with a metal shell of a mating connector; wherein the fixing portions are disposed near the rear side of the housing; wherein the housing further has a main body and a tongue board extending forwardly from the main body, and wherein the channels are defined in a main face of the tongue board and integrally through the main body; wherein the metal shell includes a first shield encasing the main body and a second shield encasing the tongue board.

2. The electrical connector of claim 1, wherein the arms integrally depend from two complementary half-portions of a top of the second shield respectively, the half-portions being fittingly held together at a seam defined therebetween.

3. The electrical connector of claim 2, wherein the half-portions are generally coplanar, and are irregularly but complementarily shaped.

4. An electrical connector comprising:

a insulative housing having a main body and a tongue board extending forwardly from a front of the main body, a plurality of channels being defined in a main face of the tongue board and respectively integrally through the main body;

a plurality of electrical contacts arranged in the channels, each contact having a mating portion disposed in a corresponding channel in the tongue board, a retaining portion fixed in the main body, and a tail portion protruding outside a rear end of the main body;

a metal shell shielding the housing, the metal shell having a frame encasing the tongue board, a fork-shaped foot extending therefrom and adjacent to the main body of the housing for insertion into a circuit board, a resilient tab being provided on each of opposite sidewalls of said frame adapted for electrical connection with a metal shell of a matins connector, and two arms extending from a top of the frame over outer faces of the opposite sidewalls of the frame respectively, each arm having a soldering portion at a lower end thereof adapted for soldering to a circuit board, the foot and the soldering portions being disposed above bottom portions of the insulative housing and the metal shell; wherein the channels are defined generally horizontally, and are arranged parallel to each other; wherein the metal shell includes a shield surrounding the main body, and the foot is integrally formed with the shield.

5. The electrical connector of claim 4, wherein each of the arms is integrally formed with a horizontal portion of a top wall of the frame, and each of the soldering portions is generally horizontal.

6. An electrical connector mounted on a printed circuit board, the circuit board defining a cutout therein, the electrical connector comprising:

an insulative housing having a main body and a tongue board extending from a front face of the main body, the tongue board defining a plurality of parallel channels in a main face thereof, the channels respectively integrally extending through the main body;

a plurality of conductive contacts received in corresponding channels, each contact having a mating portion disposed in the tongue board and adapted for electrically engaging with a mating connector, and a tail portion protruding from a rear face of the main body of the housing and adapted to be soldered to the circuit board;

a metal shell surrounding the housing, the shell having a first shield encasing the main body and a second shield encasing the tongue board, the first shield forming at least one depending fork-shape foot extending through the circuit board to engage therewith, the second shield forming a soldering portion surface mounted to a top face of the circuit board, the soldering portion being located adjacent a sidewall of the second shield, a plurality of resilient tabs being formed on the second shield and being adapted for electrically engaging with a metal shell of the mating connector; and bottom portions of the insulative housing and the metal shell which are located below the cutout and a bottom face of the circuit board; wherein the soldering portion is directly formed from the side wall of the second shield of the metal shell at a position between the resilient tabs.

* * * * *